United States Patent [19]

Deeg et al.

[11] 4,445,647

[45] May 1, 1984

[54] SUPPLY ROLL HOLDING ARRANGEMENT

[75] Inventors: Reinhard Deeg, Keltern-Ellmendingen; Folker Galaske, Pforzheim; Helmuth Kettenbach, Ettlingen, all of Fed. Rep. of Germany

[73] Assignee: International Standard Electric Corporation, New York, N.Y.

[21] Appl. No.: 416,652

[22] Filed: Sep. 10, 1982

[30] Foreign Application Priority Data

Sep. 11, 1981 [DE] Fed. Rep. of Germany ..... 3136040

[51] Int. Cl.[3] ..... B65H 17/52; B65H 23/00

[52] U.S. Cl. ..... 242/68.4; 242/76; 400/613; 400/619

[58] Field of Search ..... 242/68.4, 68, 129.6, 242/129.62, 55.2, 67.3 R, 76; 400/613, 613.1, 619

[56] References Cited

U.S. PATENT DOCUMENTS

| | | | |
|---|---|---|---|
| 2,735,684 | 2/1956 | Longee et al. | 242/55.2 X |
| 2,747,807 | 5/1956 | Hummel | 242/55.2 |
| 3,730,452 | 5/1973 | Schwartz | 242/68.4 |
| 3,834,643 | 9/1974 | Savveur et al. | 242/76 X |
| 3,908,810 | 9/1975 | Denley | 400/613 |
| 4,014,426 | 3/1977 | Neufeld | 242/68.4 |

FOREIGN PATENT DOCUMENTS

| | | | |
|---|---|---|---|
| 736537 | 9/1955 | United Kingdom | 242/68.4 |
| 742229 | 12/1955 | United Kingdom | 242/129.6 |

*Primary Examiner*—John M. Jillions

*Attorney, Agent, or Firm*—T. E. Kristofferson; A. D. Stolzy

[57] ABSTRACT

A holding arrangement for the supply roll 6 of a tape-shaped recording medium is firmly arranged on the stationary part 1 of the cover of a printer. The holding brackets 2 are provided with bearings 22 which are open in the upward direction. Into these bearings there is inserted a tubular roll carrier 5 on which the supply roll 6 is supported in a freely rotatable manner. The holding brackets 2 are provided with rotatable latch bodies 3 by which the bearings 22 which are open towards above, can be closed. The latch bodies 3 are rigidly in connection with one another via a paper-deflecting yoke 4. In the turned up state of the yoke 4, the bearings 22 which are opened towards above, are unlatched. In order to enable the use of supply rolls of different widths A and B, one of the supporting brackets 2 is provided with a detachable spacing plate 7. By re-plugging the spacing plate 7, the clear spacing in relation to the other supporting bracket 2 can be adjusted to either of the widths A or B of the respective paper roll.

5 Claims, 8 Drawing Figures

42
2
23
1
32
22
24
26
4
32

SUPPLY ROLL HOLDING ARRANGEMENT

The invention relates to a holding arrangement for the supply roll of a tape-shaped recording medium, disposed on the cover of a printer, in which a roll carrier for taking up the supply roll, rests with its projecting ends in the upwardly open bearings of holding brackets capable of being locked by latch bodies rotatable from the outside, which each have an external latch knob and a rectangularly projecting latch tongue.

Description of the Prior Art

In the case of printers which are designed for handling tape-shaped recording media, the supply roll is often arranged outside the housing. The bearing is effected in a holding arrangement disposed on the rear, stationary part of the cover. This arrangement, however, requires a paper-deflecting yoke by which the printed paper tape as emerging from the printer, is led over the supply roll.

One supply roll holding arrangement of the type mentioned hereinbefore, is already known from a commercially available type of printer (teleprinter T 1000 of Siemens AG). The outer part of the latch bodies is designed as a knurled (milled) edge. For locking the inserted supply roll, these bodies have to be separately actuated. Thereafter, the paper deflecting yoke which, for inserting the supply roll into its holding arrangement, is necessarily turned down, must be separately returned into its operating position. The roll carrier taking up the supply roll, for the purpose of being adjusted to different paper widths, is provided on its one side with an adjustable wire clip. This clip forms a limit stop for the supply roll. In order to secure the limit stop position, the roll carrier is provided with spring elements via which the supply roll is connected to the roll carrier by way of friction contact.

The locking in position of the roll carrier must be separately carried out by hand on both sides. The paper-deflecting yoke must be handled additionally. This manipulation is circumstantial and is likely to cause that above all the locking in position of the supply roll is forgotten. This is likely to have ill effects in cases where the printer is subjected to shocks and vibrations. Moreover, it is not quite simple to insert the supply roll on the roll carrier or to remove the empty core because, in so doing, the frictional resistance caused by the spring elements has to be overcome. The roll carrier only fits into the holding arrangement when inserted in a predetermined position. A supply roll inserted in the wrong position by mistake, must be removed and reinserted.

Object and Solution

It is the object of the invention to simplify the replacement of a supply roll.

This object is achieved by the features set forth in the characterizing part of claim 1. Advantageous embodiments of the subject matter of the invention are set forth in the subclaims.

Advantages

The advantages resulting from the invention, reside above all in that the latching and the unlatching of the roll carrier is effected in the most simple way, automatically via the paper deflecting yoke, that the roll carrier is a simple piece of tubing on which the supply roll is supported in a freely rotatable manner, and that the fixing of the supply roll on the roll carrier is effected with the aid of a spacing plate capable of being adjusted to various paper widths.

DESCRIPTION OF THE PREFERRED EMBODIMENT

Figure 1:
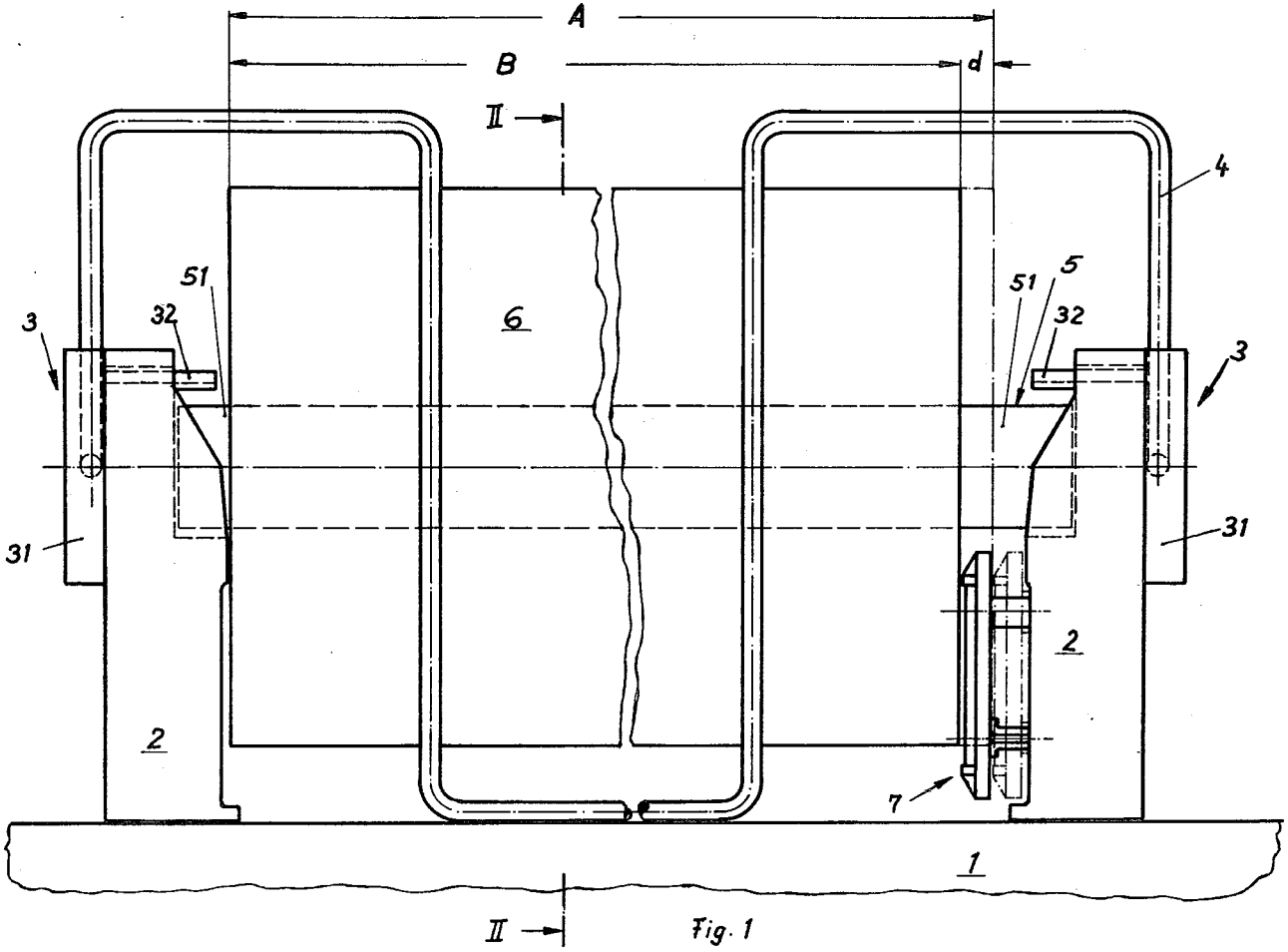
Figure 2:
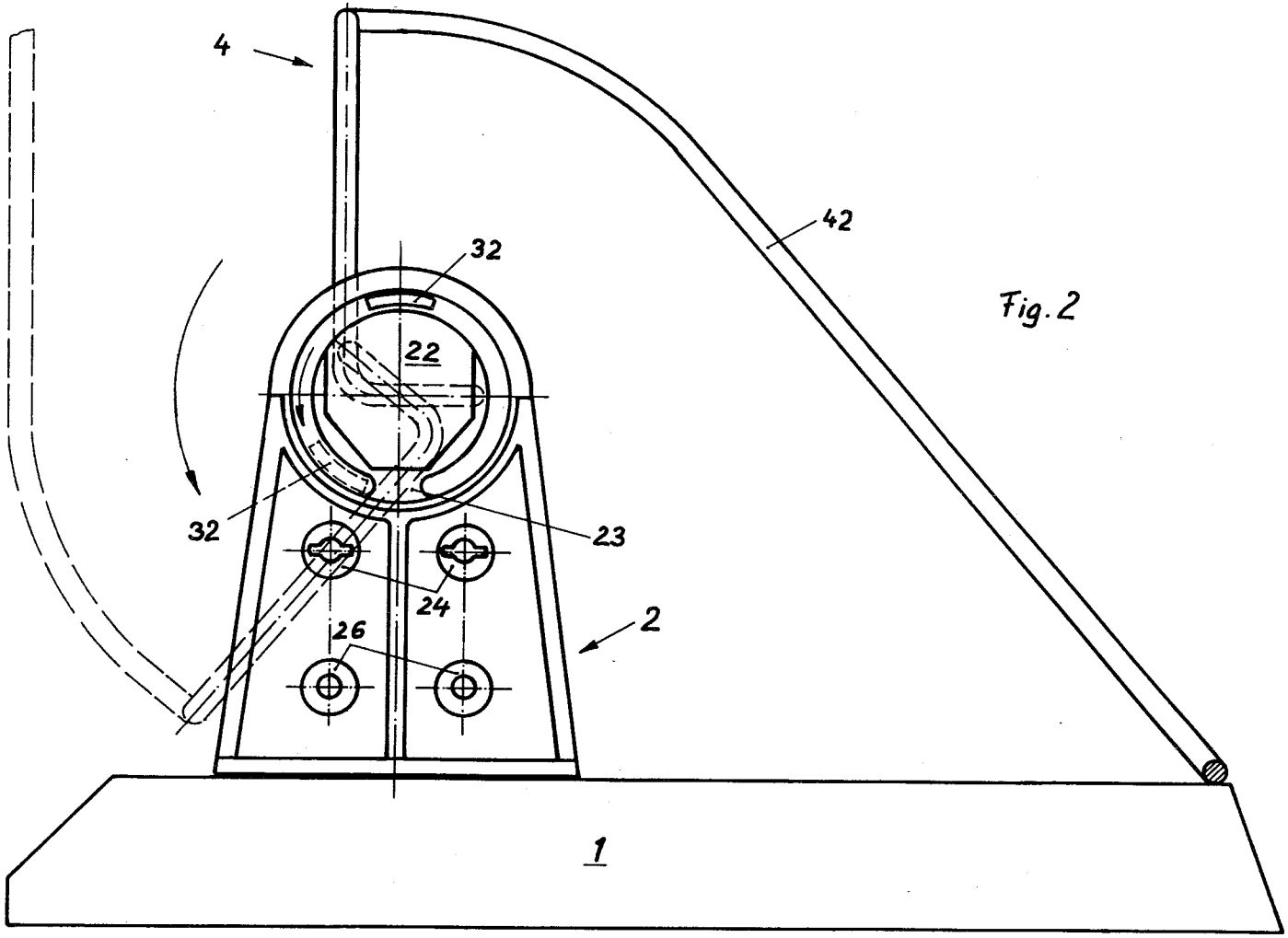

The invention will now be explained in greater detail with reference to an example of embodiment shown in FIGS. 1 to 7 of the accompanying drawings, in which:

FIG. 1 shows a supply roll holding arrangement according to the invention, in a front view, FIG. 2 shows the holding arrangement in a section taken on line II—II of FIG. 1. Both the supply roll and the roll carrier are removed, FIG. 3 shows a separate latch body as used with the holding arrangement according to FIG. 1, in a front view with the inserted paper deflecting yoke, FIG. 4 shows one holding support of the holding arrangement according to FIG. 1, in a front view, FIG. 5 shows the holding bracket in a section taken on line V—V of FIG. 4, FIG. 6 shows the latch body according to FIG. 3 in a side view, with the paper-deflecting yoke removed, and FIGS. 7*a* and 7*b* show a plug-in type spacing plate in both a side and a front view.

FIG. 1 shows a holding arrangement for the supply roll 6 of a tape-shaped recording medium, disposed for example, on the rearward, stationary part of the cover 1 of a printer. FIG. 2 shows the holding arrangement in a section taken on line II—II of FIG. 1. The holding arrangement consists of two holding brackets 2 disposed opposite each other at a spaced relation, in which latch bodies 3 are pivotally mounted. The respective latch body 3 chiefly consists of an external latch knob 31 and of a rectangularly projecting latch tongue 32. The ends of a paper-deflecting yoke 4 are supported in the latch knobs 31 of the two holding brackets, thus connecting them rigidly to one another. In the position as shown, the paper-deflecting yoke 4 rests with its arm 42 on the cover 1. In this operating position, the two latch tongues 32 are in the locking position, as can be well recognized from FIGS. 1 and 2. By turning the yoke 4 up in the direction as indicated by the arrow (FIG. 2) the latch tongues 32 are swivelled out of the locked position into a limiting stop position on a bearing bracket 23, in which the arm 42 of the yoke 4 stands vertically upright behind the holding arrangement. In this position, the supply roll 6 as slipped on to a tubular roll carrier 5, can be inserted into the holding arrangement. The roll carrier 5 is longer than the width of the supply roll 6. With its projecting ends 51 it rests in the upwardly open bearings 22 (FIG. 2) of the two holding brackets 2. The clear widths between the two holding brackets 2 can be adjusted via a spacing plate 7, to two different widths A and B of the supply roll 6, which differ by a difference d. The spacing plate 7 is arranged capable of being re-plugged into the plug holes 24 and 26 (FIG. 2) of the right-hand holding bracket 2.

Figures 3, 4, 5, 6, 7A, 7B:
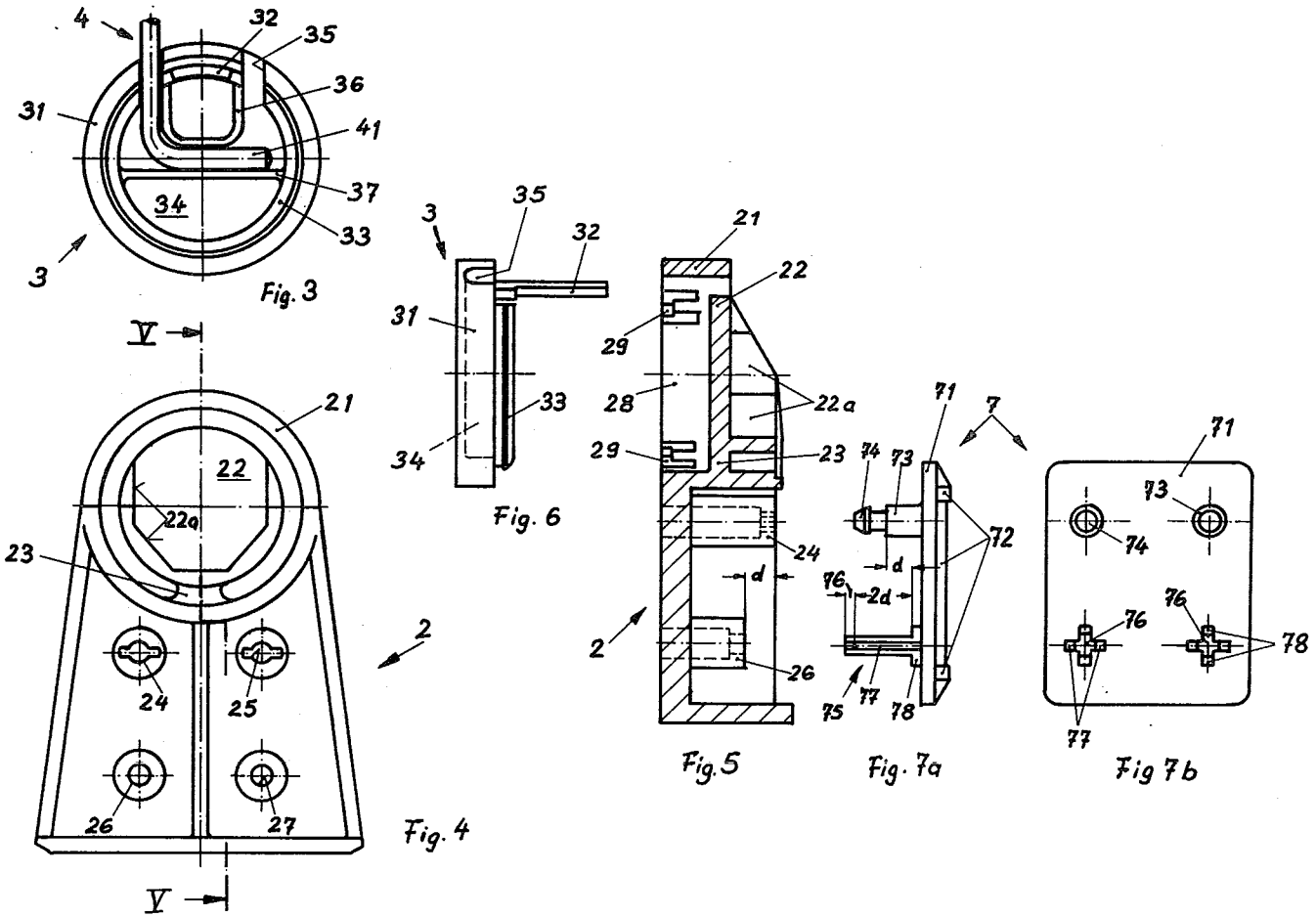

FIG. 3, in a front view, shows a latch body 3 of the type as used with the holding arrangement according to FIG. 1. FIG. 6 shows the latch body 3 in a side view. The latch knob 31 is a disk-shaped body. On the inside of the latch knob 31 there is provided a detent ring 33 of smaller diameter. Within the area of this ring 33 there is arranged the latch tongue 32. The latch knob 31 is provided on its inside with a centrical recess 34. Therein, and below the center there is provided a web 37. On the right and the left of the latch tongue 32, and rectangularly in relation to the web 37, open slots 35 are let into the latch knob 31. These slots serve to take up the angled off ends 41 of the paper-deflecting yoke 4. Prior to the insertion of the latch body 3 into the supporting bracket 2 (FIG. 4), the angled-off end 41 of the yoke 4 is clamped between the web 37 and a U-shaped limit stop 36, and the following yoke portion is pushed into one of the two slots 35. By the interlocking of the latch body 3 to the respective holding bracket 2, which is still to be described in detail hereinafter, there is fixed the previously described position of the yoke ends 41. Since the latch bodies 3, just like the holding brackets 2, are used in a mirror-inverted manner, there are provided two slots 35 of which each time only one is used.

FIG. 4 shows one holding bracket 2 in a front view. The other part of the bracket consists of a bearing ring 21 which encloses a free space. Concentrically in relation to the bearing ring 21 there is arranged inside this space a bearing 22 which is open in the upward direction and which, via a bearing bracket 23, is firmly connected to the lower part of the holding bracket 2. The inside of the bearing 22 is subdivided into individual surfaces 22*a* which are arranged in the form of an octagon which is open towards above. The roll carrier 5 which, when the supply roll 6 (FIG. 1), in inserted, is supported in the bearings 22, only rests on the inclined surfaces 22*a*. In this way it is safe-guarded that the round roll carrier 5 is in a sufficiently firm position when the recording medium is being pulled off the supply roll 6.

Plug holes 24 and 26 are countersunk in the lower part of the holding bracket 2. They are identical in pairs and arranged in a rectangle. The upper plug holes 24 are by the difference d longer than the lower plug holes 26 (FIG. 5). While the latter have an axially directed detent opening 27, the longer plug holes 24 are provided with a profile opening 25. This is composed of an opening corresponding to the detent opening 27, and of a transverse slot.

FIG. 5 shows the holding bracket 2 in a section taken on line V—V of FIG. 4. Within the area of the bearing ring 21 there is provided a rearward recess 28. Within the area of this recess, resilient detent members 29 are let into the bearing ring 21, by being arranged in a square. These detent members correspond to the detent ring 33 on the latch knob 31 (FIG. 6). When the latch body 3 is inserted into the supporting bracket 2, the detent members 29 engage behind the ring 33. In this way the body 3 is supported concentrically rotatable in the supporting bracket 2. The latch tongue 32 extends through the free interspace between the bearing ring 21 and the bearing 22. The latch tongue 32 is so long as to cover the major part of the open bearing 22 in the axial direction. As can be best recognized from the sectional representation of FIG. 5, both the bearing ring 21 and the bearing 22 which is open towards above, are bevelled above the common center axis up to the level of the rear wall of the bearing.

As already mentioned hereinbefore, the plugholes 24 and 26 as provided for in the lower part of the supporting bracket 2, are differently long. While the plugholes 24 are flush with the front side of the supporting bracket 2, the plugholes 26 are shorter by the amount d. With body types of plugholes, the openings 25 and 27 (FIG. 4), are undercut as shown in FIG. 5, so that detent means are capable of engaging.

As already mentioned hereinbefore, the plug holes 24 and 26 serve to take up the plug-in type spacing plate 7 as is shown in FIGS. 7*a* and 7*b* in a side or front view respectively. The shown position of the spacing plate 7 in relation to the supporting bracket 2 as shown in FIG. 5, is the position in which, when the spacing plate 7 is inserted, the holding arrangement is adjusted to the width B of the supply roll, as shown in FIG. 1.

The spacing plate 7 has a base 71 which, on its outside, is provided with transverse and cross webs 72. Below the cross webs, the base 71 is provided with markings respectively referring to the width A or the width B. These marks are arranged in such a way as to be readable in the respective plug-in position only. The supply roll 6 comes to lie against the transverse webs. The cross webs only serve to reinforce the base 71. On the rear side thereof, in alignment with the plug holes 24 and 26, there are arranged two circular spacing bolts 73 and two profile bolts 75. The spacing bolts 73 are provided with detent members 74 at their front ends and, in their diameters, correspond to the detent openings 27 and the circular center hole of the profile openings 25. The profile bolts 75 have a cross-shaped cross section which, at the front, within the range of an attachment 76, is reduced to the diameter of the detent openings 27. Following the attachment 76, the horizontal cross webs 77 are widened in order to correspond to the width of the transverse slot of the profile openings 25 (FIG. 7*b*). At the base points of the profile bolts 75, the vertical cross webs 78 are widened (FIG. 7*b*). They have the function of a limit stop. The effective length of the profile bolts 75, i.e., the area between the vertical cross webs 78 and the attachment 76 is equal to double the width of the difference d. The spacing bolts 73 are as long as one width of the difference d plus the thickness of the cross webs 78.

When the spacing plate is plugged in the position as shown in FIG. 7*a*, into the supporting brackets 2, the detent members 74 come into engagement with the profile openings 25 and, in the limiting stop position of the bolts 73, interlock the plug holes 24 with the bolts 73. The profile bolts 75, only with their attachments 76, come into engagement with the detent openings 27 of the plug holes 26 to which they apply via the face sides of the more wider cross webs 77. In this plug-in position, the holding arrangement is adjusted to the width B. By turning the spacing plate 7, it is possible to assume the other plug-in position, in which the clear distance between the spacing plate 7 and the other holding bracket 2 corresponds to the width A. In this case, the profile bolts 75 come into engagement with the corresponding profile opening 25 of the upper plug holes 24. With the cross webs 78 they come to lie against the face sides of the plug holes 24, while the bolts 73, via their detent members 74, come into a locking engagement with the lower plug holes 26 and are applied to the face sides thereof.

We claim:

1. A holding arrangement for the supply roll of a tape-shaped recording medium, disposed on the cover of a printer, in which a roll carrier for taking up the supply roll, rests with its projecting ends in the upwardly open bearings of holding brackets capable of being locked by latch bodies rotatable from the outside, which each have an external latch knob characterized in that a paper-deflecting yoke is provided, said latch knobs being each provided with a receptacle having a slot to take up angled off ends of said paper-deflecting yoke, said receptacle extending vertically in relation to the axis of rotation, for taking up the ends of said yoke connecting said latch bodies rigidly with one another, said yoke having one arm inclined towards the printer, with which it rests on said cover and, in the unlocked position of said latch tongues is turned up, said latch tongues being swivelled out of a locked position into a limiting stop position.

2. A holding arrangement as claimed in claim 1, characterized in that detent means are provided, said latch bodies being pivotally mounted via said detent means.

3. A holding arrangement as claimed in claim 1, characterized in that a bearing ring is carried by each individual holding bracket in the center thereof, a bearing bracket, said bearing ring having an upwardly open bearing concentrically arranged and which, in the downward direction, via said bearing bracket is firmly connected to the associated holding bracket, that the inside of said bearing consists of individual surfaces arranged within an upwardly open octagon, and that said bearing ring and said bearing are rearwardly bevelled.

4. A holding arrangement as claimed in claim 1, characterized in that one of said holding brackets is provided with a plug-in device including plug holes fixed to said holding bracket inside thereof, a spacing plate being provided which is capable of being plugged in said plug holes in two positions, i.e., in such a way that two different spacings for correspondingly wide supply rolls will result between said spacing plate and the respective other holding bracket.

5. A holding arrangement for the supply roll of a tape-shaped recording medium, disposed on the cover of a printer, in which a roll carrier for taking up the supply roll, rests with its projecting ends in the upwardly open bearings of holding brackets capable of being locked by latch bodies rotatable from the outside, which each have an external latch knob characterized in that a paper-deflecting yoke is provided, said latch knobs being each provided with a receptacle extending vertically in relation to the axis of rotation, for taking up the ends of said yoke connecting said latch bodies rigidly with one another, said yoke having said one arm inclined towards the printer, said latch tongues being swivelled out of a locked position into a limiting stop position characterized in that one of said holding brackets is provided on its inside with a plug-in device including plug holes fixed to said holding brackets inside thereof, a spacing plate being provided which is capable of being plugged in two positions, i.e., in such a way that two different spacings for correspondingly wide supply rolls will result between said spacing plate and the respective other holding bracket, characterized in that said plug holes are longer by the difference of the supply roll width than said plug holes, that the one type of plug holes are provided with a circular detent opening, and that said other plug holes have a profile opening including the shape of said detent opening, characterized in that said spacing plate according to said openings in said plug holes are provided with spacing bolts and profile bolts, that the effective length of said profile bolts is double as great as the difference in the widths of the supply roll, that said profile bolts are provided at their front end with an attachment of the same diameter as that of said detent openings, and that said spacing bolts are each provided with a detent member at their front ends.

* * * * *